US006662695B2

(12) United States Patent
Bettacchini et al.

(10) Patent No.: US 6,662,695 B2
(45) **Date of Patent: *Dec. 16, 2003**

(54) LOCKING ARRANGEMENT FOR TABLE SAW GUARD

(75) Inventors: Marcello Bettacchini, Perugia (IT); Mirco Rossetti, Perugia (IT); Lucio Ginocchini, Perugia (IT)

(73) Assignee: Blacker & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/151,531

(22) Filed: May 20, 2002

(65) Prior Publication Data

US 2002/0134211 A1 Sep. 26, 2002

Related U.S. Application Data

(63) Continuation of application No. 09/512,782, filed on Feb. 25, 2000, now Pat. No. 6,415,699.

(30) Foreign Application Priority Data

Feb. 27, 1999 (GB) ..... 9904481

(51) Int. Cl.[7] ..... B27G 19/02

(52) U.S. Cl. ..... 83/397; 93/478; 93/573; 93/DIG. 1

(58) Field of Search ..... 83/397, 478, 860, 83/544, DIG. 1, 571, 573, 490; 30/391; 192/129 R, 130, 131 R, 131 H, 132, 133, 134, 135, 136, 137, 129 A, 129 B

(56) References Cited

U.S. PATENT DOCUMENTS 1,811,577 A * 6/1931 Crowe ..... 30/391
1,900,553 A * 3/1933 Arnoldy ..... 83/397
2,722,246 A * 11/1955 Hampton ..... 53/397
3,177,909 A * 4/1965 Laube ..... 30/391
3,613,748 A * 10/1971 De Pue ..... 30/391
3,787,973 A * 1/1974 Beisch ..... 30/391
3,805,639 A * 4/1974 Peter ..... 83/860
3,922,785 A * 12/1975 Fushiya ..... 83/478
4,672,746 A * 6/1987 Zeilenga ..... 83/478
4,693,008 A * 9/1987 Velie ..... 83/478
4,805,504 A * 2/1989 Fushiya et al. ..... 83/397
5,075,976 A * 12/1991 Young ..... 30/391
5,129,300 A * 7/1992 Kawakami ..... 83/471.2
5,184,534 A * 2/1993 Lee ..... 83/397
5,370,025 A * 12/1994 Itzov ..... 83/397
5,699,705 A * 12/1997 Sibbet ..... 83/13
5,752,421 A * 5/1998 Chang ..... 83/397
5,782,001 A * 7/1998 Gray ..... 30/391
5,832,614 A * 11/1998 Gallagher et al. ..... 30/391
5,957,021 A * 9/1999 Meredith et al. ..... 83/397
6,014,813 A * 1/2000 Merino ..... 30/391

FOREIGN PATENT DOCUMENTS

DE 29507654 * 9/1996
DE 19743498 A1 * 4/1998

* cited by examiner

*Primary Examiner*—Stephen Choi
(74) *Attorney, Agent, or Firm*—Adan Ayala

(57) ABSTRACT

A saw comprising a saw assembly including an upper saw blade guard and a motor which can be actuated by an on-off switch arrangement and can rotatingly drive a saw blade mounted on the assembly. The saw assembly is pivotably mounted on a saw table such that the saw assembly can be lowered towards the table to cut a workpiece resting on the table. The saw includes a lower moveable guard which is pivotably mounted to the upper guard so that the lower guard is moveable to expose a saw blade mounted on the assembly and a guard lock arrangement is used for locking the lower guard over a saw blade mounted on the saw assembly when the saw is not in use. The guard lock arrangement includes a guard lock lever moveably mounted to the saw assembly. The guard lock lever includes a locking portion and a switch actuation portion such that in an off-position of the guard lock lever the locking portion engages the lower guard to prevent it from moving and in an on-position of the guard lock lever the locking portion is disengaged from the lower guard so that the lower guard is free to move to expose the saw blade and the switch actuation portion engages the on-off switch arrangement.

8 Claims, 2 Drawing Sheets

LOCKING ARRANGEMENT FOR TABLE SAW GUARD

CROSS-REFERENCE TO RELATED APPLICATIONS

This application is a continuation of U.S. patent application Ser. No. 09/512,782, filed on Feb. 25, 2000, now U.S. Pat. No. 6,415,699.

FIELD OF INVENTION

The present invention relates to saws, such as chop saws, miter saws and flip over saws, and in particular relates to saws comprising a table and a saw assembly carrying a motor driven saw blade which is pivotally mounted on the table such that the saw assembly can be lowered towards the table to plunge the saw blade into a workpiece, resting on the table.

BACKGROUND OF INVENTION

Such saws generally have a fixed upper saw blade guard covering the upper part of the saw blade and a moveable lower saw blade guard for selectively exposing the saw blade when a cut is to be made in a workpiece and otherwise for protecting the user from the lower part of the saw blade. It is desirable when the saw is not in use, for example when it is transported from one work site to another, that the lower blade guard is locked closed so that the saw blade is protected by the upper and lower guards. However, when the saw is in use and its saw assembly is lowered towards the saw table, the lower blade guard should be unlocked and free to open to expose the saw blade so that the saw blade can make a cut in a workpiece.

A known guard lock arrangement is known from German patent application DE 197 43 498. This application relates to a locking mechanism in which the moveable lower guard of the saw is locked against movement which would expose the saw blade by a locking pin. The on-off switch for the motor of the saw is activated by a trigger element on the handle of the saw, which trigger element co-operates with a lock-off lever actuated by a release knob. The lock-off lever prevents movement of the trigger element so that the saw cannot be operated. The release knob is activated to move the lock-off lever into a position in which the trigger element can be depressed to switch on the motor. This activation of the release knob also releases the locking pin via a moveable articulated linkage arrangement so that the lower guard can be retracted when the saw assembly is lowered towards the saw table. This arrangement requires numerous moving parts which co-operate to unlock the guard when the lock-off lever is released by actuation of the release knob. As such the arrangement is quite complicated and after prolonged use of the saw can become vulnerable to the ingress of dust created by use of the saw, which dust can block the operation of the guard lock arrangement making it difficult for a user to operate.

Accordingly the present invention aims to provide a simplified guard lock arrangement which requires fewer moving parts than known arrangements and which accordingly is less vulnerable to becoming blocked or difficult to operate due to the ingress of dust.

SUMMARY OF THE INVENTION

According to the present invention there is provided a saw comprising a saw assembly comprising an upper saw blade guard and a motor which can be actuated by an on-off switch arrangement and can rotatingly drive a saw blade mounted on the assembly, which saw assembly is pivotably mounted on a saw table such that the saw assembly can be lowered towards the table to cut a workpiece resting on the table, a lower moveable guard which is mounted to the upper guard so that the lower guard is moveable to expose a saw blade mounted on the assembly, a guard lock arrangement operable by a user of the saw for locking the lower guard over a saw blade mounted on the saw assembly when the saw is not in use, where the guard lock arrangement comprises a guard lock lever which is moveably mounted to the saw assembly and comprises a locking portion and a switch actuation portion such that in an off-position of the guard lock lever the locking portion engages the lower guard to prevent it from moving and in an on-position of the guard lock lever the locking portion is disengaged from the lower guard so that the lower guard is free to move to expose the saw blade and the switch actuation portion engages the on-off switch arrangement.

In this way a single moveable part, the guard lock lever, is used to releasably lock the lower guard and to actuate the on-off switch arrangement of the motor. This provides a much simplified guard lock arrangement which reduces the number of components required in a saw of this type. Furthermore, the use of fewer moving parts makes the guard lock arrangement less vulnerable to the ingress of dust created when the saw is in use.

If the guard lock lever is mounted on the inside of the housing of the saw assembly so that the part of the lever which is accessed by a user extends outside of the housing through a hole in the housing, dust can enter the housing through this hole and infiltrate components located within the housing. Therefore, it is preferred that the guard lock lever according to the present invention is mounted on the outside of the saw assembly. For convenient actuation by a user of the saw the guard lock lever is preferably mounted on a handle provided on the saw assembly which handle is used by a user to lower the saw assembly towards the saw table.

In a preferred embodiment the guard lock lever is pivotally mounted to the saw assembly and preferably the switch actuation portion is located at a first end of the guard lock lever and the guard lock lever is pivotally mounted on the saw assembly at a second opposite end of the guard lock lever. More preferably, the guard lock lever is L-shaped and the locking portion extends from the bend in the guard lock lever.

The locking portion of the guard lock lever can simply comprise a latch extension which is engageable with a co-operating latch means on the lower blade guard. The co-operating latch means on the lower blade guard may simply comprise a recess formed in the lower blade guard.

BRIEF DESCRIPTION OF DRAWINGS

One form of a chop saw guard arrangement according to the present invention will now be described by way of example with reference to the accompanying drawings in which.

DETAILED DESCRIPTION OF INVENTION

Figure 1:
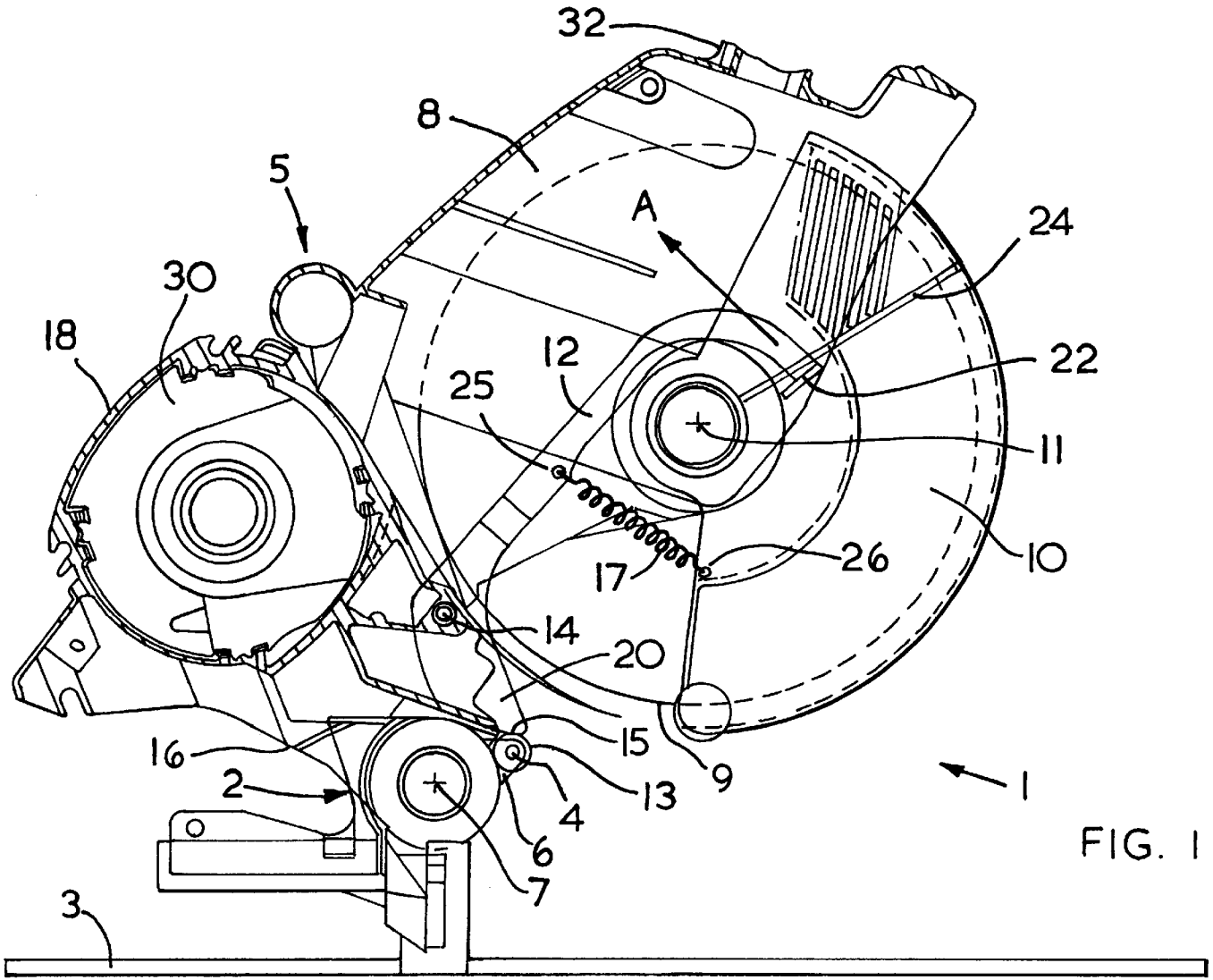
FIG. 1 shows a partial cross-section of a chop saw guard arrangement according to the present invention.
Figure 2:
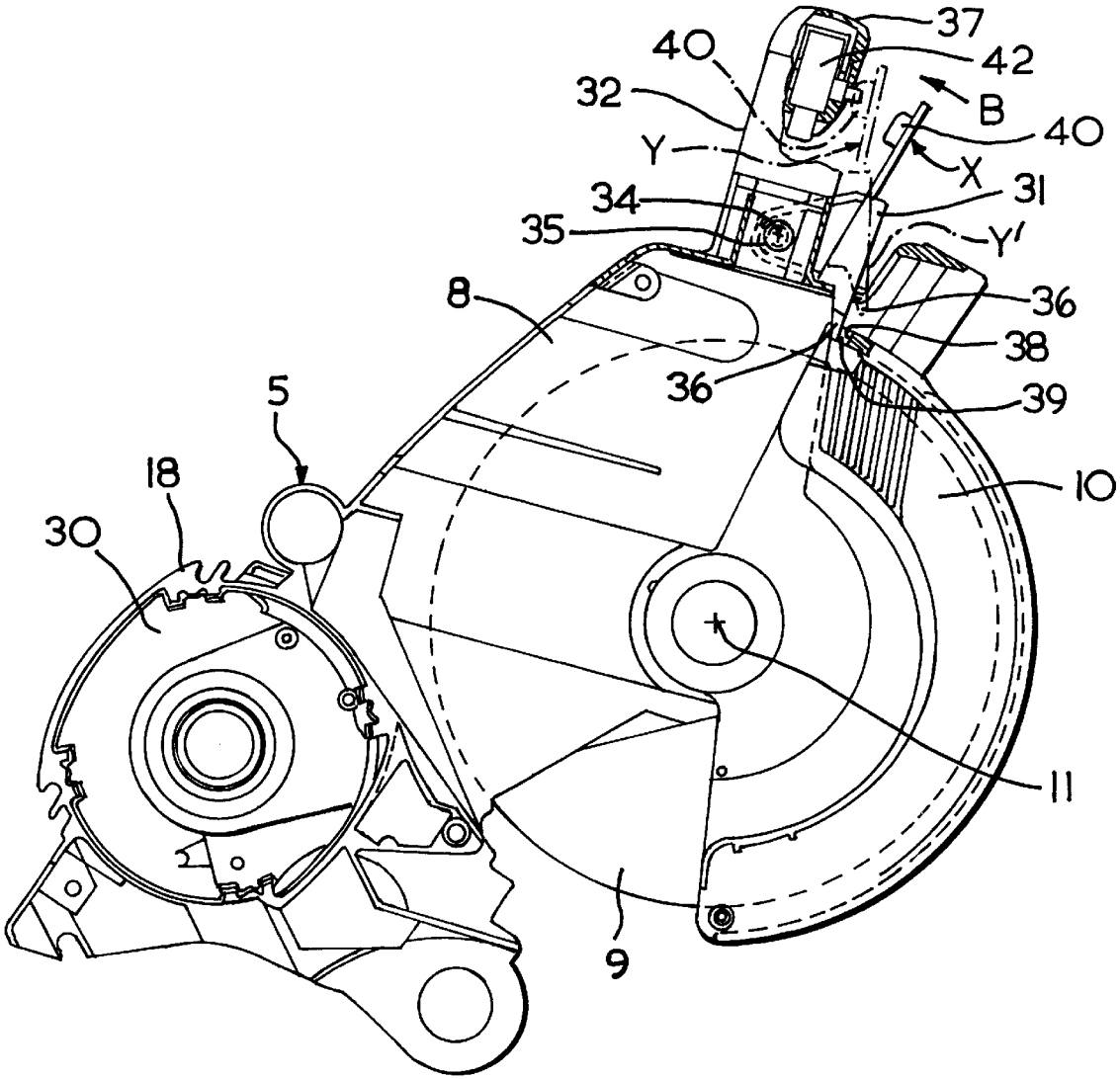
FIG. 2 shows a side view of the guard arrangement of FIG. 1.

The saw (1) has a base table (3) on which is located a pivot block (2). A saw housing (5) is mounted pivotally on the pivot block (2) about a pivot axis (7). The saw housing (5) comprises a motor (30) for driving a circular saw blade (9) about an axis (11), a motor casing (18) within which the motor (30) is mounted and a fixed upper saw blade guard (8) which covers the upper part of the saw blade (9). The housing (5) is actuated by a handle (32) (shown fully in FIG. 2) to pivot the housing (5) about pivot axis (7) and plunge the blade (9) into a slot (not shown) in the table (3), through a workpiece (not shown) resting on the table (3).

Attached to the pivot block (2) is a bearing which takes the form of a roller (13) mounted on an axle (4). The axle (4) is formed by a bolt which passes through a receiving hole formed in an arm (6) which extends from a part of the pivot block (2) which is fixed to the saw table (3) and so does not pivot about the axis (7) when the saw housing (5) is lowered. The roller (13) is mounted for rotation on the part of the bolt (4) which extends from the arm (6).

A retractable lower guard (10) is pivotally mounted to the fixed upper guard (8) about axis (11) so that the lower guard (10) can be retracted into the upper guard (8) to expose the saw blade (9). A single rigid lever (12) is used to cause the lower guard (10) to retract into the upper guard (8) to expose the saw blade (9) when the saw housing (5) is pivoted about axis (7) towards the saw table (3). The lever (12) is substantially U-shaped. shaped. At a first bend in its lower part the lever (12) is pivotally mounted at hinge point (14) to an extension (16) of the saw housing (5). A first lower end (20) of the lever (12) adjacent to the first bend has an end surface (15) which bears against the bearing (13). The surface of the bearing (13) forms an open cam surface against which the end surface (15) of the lever bears. At the opposite second end of the lever (12) is located a plastic ledge (22) which extends to one side of the lever (12) and forms an end surface of the lever which is engageable with a substantially radial rib (24). The ledge (22) forms an open end surface of the lever (12) which engages the radial rib (24) which forms an open cam surface on the lower guard (10). The rib (24) extends from the inner surface of the lower blade guard (10).

A tension spring (17) connects a middle part (25) of the lever (12) to a part (26) of the edge of the lower guard (10). The spring (17) biases the lower guard (20) towards a position in which it covers the saw blade (9).

In use when the saw housing (5) is lowered towards the saw table (3), the hinge point (14) which pivots with the saw housing (5) about axis (7) moves towards the roller bearing (13). As indicated above the roller (13) is attached to a part of the pivot block (2) which does not pivot about axis (7). The engagement of the end surface (15) of the lever (12) with the roller (13) causes the lever (12) to pivot in an anti-clockwise direction about hinge point (14) as the saw housing (5) is lowered. This anti-clockwise pivoting of the lever (12) causes the second end of the lever to move relative to the upper guard (8) in the direction of arrow (A). The ledge (22) on the lever (12) engages the rib (24) and slides radially outwardly along the rib (24) and pulls the lower guard (10) causing it to pivot in an anti-clockwise direction about axis (11). In this way the lower guard (10) is retracted into the upper guard (8) to expose the saw blade (9) when the saw housing (5) is lowered towards the saw table (3). The ledge (22) is made of plastic to reduce the friction between the ledge (22) and the rib (24) as the ledge slides along the rib.

After the saw blade has completed a cut into a workpiece, the saw housing (5) is moved away from the saw table (3) and the action of the tension spring (17) between points (25) and (26) causes the lower guard (10) to pivot in a clockwise manner about axis (11). The spring (17) and the relative movement of the hinge point (14) and the roller bearing (13) away from each other causes the lever (12) to pivot in a clockwise direction about hinge point (14) and the ledge (22) on the lever (12) to slide radially inwardly along the rib (24). These actions together cause the lower guard to cover the blade (9) as it is retracted from a workpiece.

The open camming engagement between the end surface (15) of the first end of the lever (12) with the surface of the roller (13) is less vulnerable to blocking by dust because it comprises two open surfaces which repeatedly bear against each other. Similarly, the open camming engagement between the end surface (22) of the second end of the first lever (12) with the rib (24) is less vulnerable to blocking by dust because it comprises two open surfaces which repeatedly bear against each other.

A guard lock lever (31) (shown in FIG. 2) is pivotally mounted using a bolt (35) about point (34) on the handle (32) which extends from the saw housing (5). The lever (31) is biased into an off-position (position X) shown in full black lines in FIG. 2 by means of a spring (not shown). The lever (31) can be moved by a user of the saw grasping a hand grip (37) provided at the end of the handle (32) into an on-position (position Y) shown in dotted lines in FIG. 2. In the on-position a projection (40) at the free end of the lever (31) engages an actuator of an on-off power switch (42) to activate the motor (30) of the saw.

The guard lock lever (31) has a locking extension (36) which in the off-position extends through a gap in the upper guard (8) to engage with an edge (38) of a slot (39) in the lower guard part (10). The engagement of the locking extension (36) with the edge (38) of the slot (39) prevents the lower guard (10) from being retracted into the upper guard part (8) to expose the saw blade (9). When the lever (31) is moved into its on-position (see Y' shown in dotted lines) the locking extension (36) is moved out of the slot (39) and the lower guard (10) can be retracted as described above. Thus, the lever (31) has the dual function of switching the motor on and off and unlocking and locking the lower guard (10).

When the motor is switched off, the lower guard (10) is locked against retraction into the upper guard (8) and so the saw housing (5) cannot be lowered far towards the saw table (3) because the lower guard (10) blocks such movement. When the motor is switched on, the lower guard is simultaneously unlocked and so the saw housing (5) can be lowered towards the saw table (3) and the lower guard (10) is retracted, as described above, into the upper guard (8) to expose the saw blade (9) so that it can make a cut into a workpiece positioned on the saw table (3).

What is claimed is:

1. A saw comprising:

a saw table, a saw assembly pivotably mounted to the saw table so that the saw assembly can be lowered towards the saw table to cut a workpiece resting on the saw table, the saw assembly comprising an upper blade guard and a motor which can be actuated by an on-off switch arrangement and can rotatingly drive a saw blade mounted on the assembly, a lower moveable guard which is mounted to the upper blade guard so that the lower guard is moveable to expose the saw blade mounted as the saw assembly is lowered towards the saw table, and a guard lock lever mounted to the saw assembly, the guard lock lever being movable between first and second positions, the guard lock lever comprising a locking portion and a switch actuation portion such that, in the first position, the locking portion engages the lower guard to prevent it from moving and, in the second position, the locking portion is disengaged from the lower guard allowing the lower guard to move to expose the saw blade, and the switch actuation portion engages the on-off switch arrangement.

2. A saw according to claim 1 wherein the guard lock lever is mounted on a handle provided on the saw assembly which handle is used by a user to lower the saw assembly towards the saw table.

3. A saw according to claim 1 wherein the guard lock lever is pivotally mounted to the saw assembly.

4. A saw according to claim 1 wherein the guard lock lever is pivotally mounted to the saw assembly, and the switch actuation portion is located at a first end of the guard lock lever.

5. A saw according to claim 1 wherein the guard lock lever is pivotally mounted to the saw assembly, the switch actuation portion is located at a first end of the guard lock lever, the guard lock lever is L-shaped and the locking portion extends from the bend in the guard lock lever.

6. A saw according to claim 1 wherein in that the locking portion comprises a latch extension which is engageable with a co-operating latch means on the lower blade guard.

7. A saw according to 1 wherein in that the locking portion comprises a latch extension which is engageable with a co-operating latch means on the lower blade guard which co-operating latch means comprises a recess formed in the lower blade guard.

8. A saw according to claim 1 wherein the guard lock lever is mounted on the outside of the saw assembly.

* * * * *